US010553977B2

(12) United States Patent
Pemwieser et al.

(10) Patent No.: US 10,553,977 B2
(45) Date of Patent: Feb. 4, 2020

(54) ELECTRICAL PLUG CONNECTOR

(71) Applicant: ROSENBERGER HOCHFREQUENZTECHNIK GMBH & CO. KG, Fridolfing (DE)

(72) Inventors: Manuel Pemwieser, Burghausen (DE); Martin Zebhauser, Laufen (DE); Christian Anfang, Bergen (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 16/078,808

(22) PCT Filed: Feb. 26, 2016

(86) PCT No.: PCT/EP2016/000339

§ 371 (c)(1),
(2) Date: Aug. 22, 2018

(87) PCT Pub. No.: WO2017/144072

PCT Pub. Date: Aug. 31, 2017

(65) Prior Publication Data

US 2019/0067862 A1 Feb. 28, 2019

(51) Int. Cl.

| | |
|---|---|
| ***H01R 13/187*** | (2006.01) |
| ***H01R 13/11*** | (2006.01) |
| ***H01R 13/41*** | (2006.01) |
| ***H01R 4/48*** | (2006.01) |
| ***H01R 24/38*** | (2011.01) |

(52) U.S. Cl.

CPC ..... *H01R 13/187* (2013.01); *H01R 4/48* (2013.01); *H01R 13/111* (2013.01); *H01R 13/41* (2013.01); *H01R 24/38* (2013.01)

(58) Field of Classification Search

CPC ..... H01R 13/187

See application file for complete search history.

(56) References Cited

U.S. PATENT DOCUMENTS

| | | | |
|---|---|---|---|
| 3,120,418 | A | 2/1964 | Deakin |
| 4,296,993 | A | 10/1981 | Wellington |

(Continued)

FOREIGN PATENT DOCUMENTS

| | | | |
|---|---|---|---|
| CN | 101340034 | A | 1/2009 |
| CN | 201608321 | U | 10/2010 |

(Continued)

*Primary Examiner* — James Harvey

(74) *Attorney, Agent, or Firm* — DeLio Peterson & Curcio LLC; Robert Curcio

(57) ABSTRACT

An electrical plug connector having a hollow cylindrical housing and having a contact sleeve in the form of a hollow cylinder having a casing wall, which contact sleeve is arranged radially inside the housing, for producing a mechanical and an electrical contact with a counterpart connector, wherein at least one contact spring tongue which can be deflected resiliently and has a free end is arranged on the casing wall of the contact sleeve and is configured in such a way that the free end projects in the radially inward direction beyond the casing wall of the contact sleeve and forms a contact surface for electrical and mechanical contacting of the counterpart connector. At least three ribs are formed on an outer periphery of the casing wall of the contact sleeve which project beyond the casing wall in a radially outward direction.

7 Claims, 2 Drawing Sheets

(56) References Cited

U.S. PATENT DOCUMENTS

| | | | | | |
|---|---|---|---|---|---|
| 4,370,014 | A * | 1/1983 | Bourdon | ..... | H01R 4/2491<br>439/409 |
| 4,572,606 | A * | 2/1986 | Neumann | ..... | H01R 13/187<br>439/843 |
| 5,147,227 | A | 9/1992 | Yurko | | |
| 2018/0366856 | A1* | 12/2018 | Pemwieser | ..... | H01R 13/187 |

FOREIGN PATENT DOCUMENTS

| | | | |
|---|---|---|---|
| DE | 202009004242 | U1 | 6/2009 |
| EP | 0476878 | A1 | 3/1992 |
| EP | 2195886 | A1 | 6/2010 |
| GB | 893055 | A | 4/1962 |

* cited by examiner

ELECTRICAL PLUG CONNECTOR

BACKGROUND OF THE INVENTION

1. Field of the Invention

The invention relates to an electrical plug connector having a hollow cylindrical housing and having a contact sleeve in the form of a hollow cylinder having a casing wall, which contact sleeve is arranged radially inside the housing, for producing a mechanical and an electrical contact with a counterpart connector, wherein at least one contact spring tongue which can be deflected resiliently and has a free end is arranged on the casing wall of the contact sleeve and is configured in such a way that the free end projects in the radially inward direction beyond the casing wall of the contact sleeve and forms a contact surface for electrical and mechanical contacting of the counterpart connector.

2. Description of Related Art

Plug connectors, in particular coaxial plug connectors, are used for the detachable connection of coaxial cables.

Coaxial plug connectors are designed coaxially, like coaxial cables, so that they exhibit the advantages of the coaxial cable, namely low electromagnetic influencing and emissions as well as good electrical shielding, as well as an impedance which corresponds to that of coaxial cables in order to avoid reflections at the transition point between a coaxial plug connector and a coaxial cable. A coaxial cable, also referred to as a coax cable, is understood to mean a two-pole cable with concentric structure which has an inner conductor (also referred to as a core) which is surrounded at a constant distance by a hollow cylindrical outer conductor. The outer conductor shields the inner conductor against electromagnetic interference radiation. An insulator or dielectric is arranged in the space between the inner conductor and the outer conductor.

Coaxial plug connectors are designed to provide a predetermined characteristic impedance, for example of 50Ω, in order to guarantee a reflection-free transmission of RF signals. The characteristic impedance of a coaxial plug connector depends, inter alia, on the ratio between the inner diameter of the outer conductor and the diameter of the inner conductor. An electrical connection of a coaxial cable to a coaxial plug connector therefore requires a coaxial plug connector adapted to the inner diameter and outer diameter of the coaxial cable.

SUMMARY OF THE INVENTION

The invention is based on the problem of improving an electrical plug connector in terms of its resistance to damage resulting from the action of external forces.

According to the invention this problem is solved through an electrical plug connector of the aforementioned type with the features characterized in the independent claims. Advantageous embodiments of the invention are described in the dependent claims.

The above and other objects, which will be apparent to those skilled in the art, are achieved in the present invention which is directed to an electrical plug connector comprising: a hollow cylindrical housing and a contact sleeve in the form of a hollow cylinder having a casing wall, which contact sleeve is arranged radially inside the housing, for producing a mechanical and an electrical contact with a counterpart connector, wherein at least one contact spring tongue which can be deflected resiliently and has a free end is arranged on the casing wall of the contact sleeve and is configured in such a way that the free end projects in the radially inward direction beyond the casing wall of the contact sleeve and forms a contact surface for electrical and mechanical contacting of the counterpart connector, wherein at least three ribs are formed on an outer periphery of the casing wall of the contact sleeve which project beyond the casing wall in a radially outward direction.

Each contact spring tongue may be formed by means of a U-shaped cut-out in the casing wall of the contact sleeve.

The ribs are preferably spaced apart equidistantly from one another in a circumferential direction in relation to the casing wall of the contact sleeve.

An outer diameter of the contact sleeve in the region of the ribs is greater than an inner diameter of the housing.

The contact sleeve may be manufactured as a stamped-bent part.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-2 of the drawings in which like numerals refer to like features of the invention.

In an electrical plug connector of the aforementioned type, according to the invention at least three ribs are formed on the outer periphery of the casing wall of the contact sleeve which project beyond the casing wall in a radially outward direction.

This has the advantage that, when a counterpart plug connector is plugged into the electrical plug connector, if an oblique tensile force is applied to the counterpart plug connector the contact sleeve is supported against the inside of housing with the ribs, thus effectively preventing damage to the contact sleeve or the resilient contact spring tongues.

A plug connector which is particularly simple to manufacture is achieved in that each contact spring tongue is formed by means of a U-shaped cut-out in the casing wall of the contact sleeve.

An equidistant and stable support of the contact sleeve on the inner side of the housing is achieved in that the ribs are spaced apart equidistantly from one another in a circumferential direction in relation to the casing wall of the contact sleeve.

A particularly secure hold of the contact sleeve in the housing by means of a restoring force resulting from an elastic deformation of the contact sleeve in the region of the ribs is achieved in that an outer diameter of the contact sleeve in the region the ribs is greater than an inner diameter of the housing.

A simple manufacture is achieved in that the contact sleeve is manufactured as a stamped-bent part.

The invention is explained in more detail with reference to the drawings.

Figure 1:
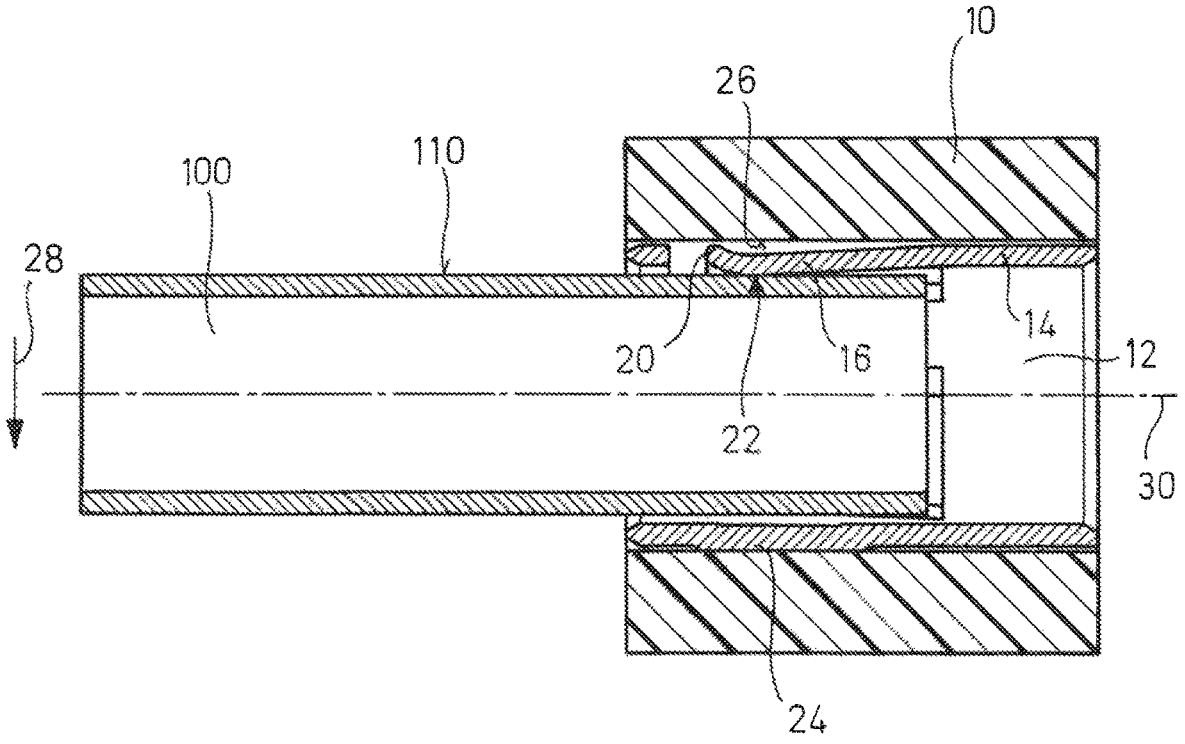
FIG. 1 shows a preferred embodiment of an electrical plug connector according to the invention in its state when plugged together with a counterpart plug connector in a sectional view.

The preferred embodiment of an electrical plug connector according to the invention shown in FIG. 1 has a housing 10 which is in the form of a hollow cylinder and which accommodates a contact sleeve 12 in its interior. The contact sleeve 12 is also in the form of a hollow cylinder and is shown in more detail in FIG. 2. As can be seen from FIG. 1, the electrical plug connector is designed for plugged connection in an axial direction with a counterpart plug connector 100, so that an electrical and mechanical contact between the electrical plug connector and the counterpart plug connector is created. This counterpart plug connector 100 has an outer surface 110 which, in the plugged-together state, faces an inner side of the contact sleeve 12.

Figure 2:
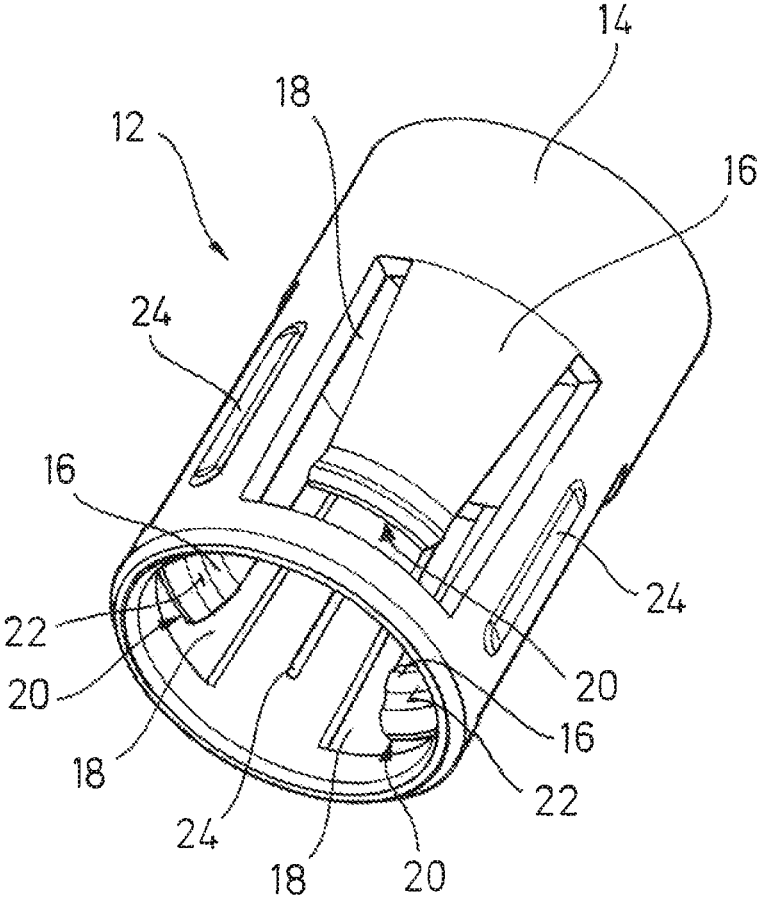
FIG. 2 shows a preferred embodiment of a contact sleeve for an electrical plug connector according to the invention in a perspective view.

As can be seen from FIG. 2, the contact sleeve 12 has a casing wall 14 and three contact spring tongues 16 formed on the casing wall 14 which can be deflected resiliently. Each contact spring tongue 16 is formed through a U-shaped cut-out 18 in the casing wall 14 and is thus connected on one side with the casing wall 14 in a form-locking manner.

In other words, each contact spring tongue 16 is a part of the casing wall 14, but is deformed relatively thereto. Each contact spring tongue 16 thereby has a free end 20 which forms an electrical contact surface 22. When the counterpart plug connector 100 is plugged in, this electrical contact surface 22 comes into electrical and mechanical contact with the outer surface 110 of the counterpart plug connector 100. The entire contact sleeve is preferably made of a resilient, electrically conductive material.

The contact spring tongues 16 are designed such that, in the unloaded state, these project with their free ends 20 in a radially inward direction beyond the contact sleeve 12 of the casing wall 14. As the counterpart plug connector 100 is pushed in, the contact spring tongues 16 are resiliently deflected through the mechanical contact with the outer surface 110 of the counterpart plug connector 100 radially outward in relation to the contact sleeve 12, so that a resilient restoring force results which, as a contact force, together with the electrical contact surface 22, establishes an electrical contact with the outer surface 110 of the counterpart plug connector 100.

According to the invention, ribs 24 are formed radially on the outside of the casing wall 14 of the contact sleeve 12 which are for example formed by means of stamping. These ribs 24 project beyond the casing wall 14 of the contact sleeve 12 in a radially outward direction and as a result come to lie against an inner wall 26 of the housing 10 (FIG. 1). In the embodiment shown, three ribs 24 are provided which extend in an axial direction in relation to the contact sleeve 12 over a predetermined axial section of the contact sleeve 12. These ribs 24 are spaced equidistantly apart from one another in a circumferential direction in relation to the contact sleeve 12, i.e., two ribs 24 which are adjacent to one another in a circumferential direction in relation to the contact sleeve 12 are offset from one another in a circumferential direction by an angle of 120°.

This equidistant distribution of three ribs 24 results in a defined position of the contact sleeve 12 inside the housing 10 and the contact sleeve 12 can be supported on the housing equally in all directions.

If, as shown in FIG. 1, an oblique tensile force 28 acts on the counterpart plug connector 100, wherein the oblique tensile force 28 is directed substantially perpendicular to a longitudinal axis 30 of the contact sleeve 12, the contact sleeve is supported in the housing 10 by means of the ribs 24 and thus cannot be damaged. A deflection of the counterpart plug connector 100 on application of the oblique tensile force 28 is prevented and, accordingly, this prevents the contact spring tongues 16 from being overstretched or damaged. The equidistant arrangement of the three ribs 24 hereby ensures that the function of support is guaranteed, irrespective of the radial direction in which the oblique tensile force 28 acts. In other words, the coaxial arrangement of housing 10, contact sleeve 12 and counterpart plug connector 100 is also substantially maintained under the action of oblique tensile forces 28.

The electrical and mechanical properties of the electrical plug connector according to the invention are therefore also maintained in the event of external forces acting on the plug connector when plugged together with the counterpart plug connector 100.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An electrical plug connector comprising: a hollow cylindrical housing and a contact sleeve in the form of a hollow cylinder having a casing wall, which contact sleeve is arranged radially inside the housing, for producing a mechanical and an electrical contact with a counterpart connector, wherein at least one contact spring tongue which can be deflected resiliently and has a free end is arranged on the casing wall of the contact sleeve and is configured in such a way that the free end projects in the radially inward direction beyond the casing wall of the contact sleeve and forms a contact surface for electrical and mechanical contacting of the counterpart connector, wherein at least three ribs are formed on an outer periphery of the casing wall of the contact sleeve which project beyond the casing wall in a radially outward direction and extending axially along the casing wall, said three ribs being spaced apart from the axial ends of the contact sleeve.

2. The electrical plug connector of claim 1, wherein each contact spring tongue is formed by means of a U-shaped cut-out in the casing wall of the contact sleeve.

3. The electrical plug connector of claim 1, wherein the ribs are spaced apart equidistantly from one another in a circumferential direction in relation to the casing wall of the contact sleeve.

4. The electrical plug connector of claim 1, wherein an outer diameter of the contact sleeve in the region of the ribs is greater than an inner diameter of the housing.

5. The electrical plug connector of claim 1, wherein the contact sleeve is manufactured as a stamped-bent part.

6. The electrical plug connector of claim 2, wherein the ribs are spaced apart equidistantly from one another in a circumferential direction in relation to the casing wall of the contact sleeve.

7. The electrical plug connector of claim 6, wherein an outer diameter of the contact sleeve in the region of the ribs is greater than an inner diameter of the housing.

* * * * *